US007261803B2

(12) United States Patent
Abe et al.

(10) Patent No.: US 7,261,803 B2
(45) Date of Patent: Aug. 28, 2007

(54) NON-CYANOGEN TYPE ELECTROLYTIC SOLUTION FOR PLATING GOLD

(75) Inventors: Miwa Abe, Nagano (JP); Kei Imafuji, Nagano (JP)

(73) Assignee: Shinko Electric Industries Co., Ltd., Nagano (JP)

( * ) Notice: Subject to any disclaimer, the term of this patent is extended or adjusted under 35 U.S.C. 154(b) by 370 days.

(21) Appl. No.: 10/661,533

(22) Filed: Sep. 15, 2003

(65) Prior Publication Data

US 2004/0069641 A1 Apr. 15, 2004

(30) Foreign Application Priority Data

Sep. 30, 2002 (JP) ..... 2002-284821
Feb. 12, 2003 (JP) ..... 2003-033101

(51) Int. Cl.
*C25D 3/48* (2006.01)

(52) U.S. Cl. ..... 205/267; 205/266

(58) Field of Classification Search ..... None
See application file for complete search history.

(56) References Cited

U.S. PATENT DOCUMENTS 3,917,885 A * 11/1975 Baker ..... 427/304
4,717,459 A * 1/1988 Nakazawa et al. ..... 205/248
4,963,974 A * 10/1990 Ushio et al. ..... 257/750
6,251,249 B1 6/2001 Chevalier et al.

FOREIGN PATENT DOCUMENTS

JP 4110488 4/1992
JP 10-317183 12/1998

OTHER PUBLICATIONS

"2-Aminoethanethiol", from Chemfinder.com.*
"Thiouracil", from Chemfinder.com.*
Schmid et al, "Metal Clusters and Colloids", Advances Materials, vol. 10, No. 7, 1998 (no month), pp. 515-523.*
Nomiya et al, "Synthesis and crystal structure of a hexanuclear silver (I) cluster . . . and a supramolecular gold(I) complex in the solid state, and their antimicrobial activities", Journal of the Chemical Society, Dalton Transactions, 2000 (no month), pp. 2091-2097.*
"2-Aminoethanethiol", from Chemfinder.com, accessed May 2006.*
"Thiouracil", from Chemfinder.com, accessed May 2006.*
Chinese Office Action for corresponding Chinese Patent Application No.: 031544401 dated Mar. 30, 2007.

* cited by examiner

*Primary Examiner*—Harry D. Wilkins, III
(74) *Attorney, Agent, or Firm*—Staas & Halsey LLP

(57) ABSTRACT

A non-cyanogen type electrolytic solution, for plating gold, contains a gold salt as a supply source of gold and is added with a non-cyanogen type compound wherein the electrolytic plating solution is added with one selected from a group of thiouracil; 2-aminoethanethiol; N-methylthiourea, 3-amino-5-mercapto-1,2,4-triazole; 4,6-dihydroxy-2-mercaptopyrimidine; and mercapto-nicotinate; as a compound forming a complexing compound with gold. Chloroaurate or gold sulfite is preferably used as a gold salt.

5 Claims, No Drawings

NON-CYANOGEN TYPE ELECTROLYTIC SOLUTION FOR PLATING GOLD

BACKGROUND OF THE INVENTION

1. Field of the Invention

The present invention relates to an electrolytic solution and, more specifically, to a non-cyanogen type electrolytic solution for plating gold, containing a gold salt as a supply source of gold and a non-cyanogen type compound.

2. Description of the Related Art

A plated gold film is excellent in electric characteristic, corrosiveness, soldering ability or others. Accordingly, when a circuit board used in a semiconductor device or the like is produced, copper patterns formed on a surface of the circuit board are subjected to electrolytic gold plating.

This electrolytic gold plating is usually carried out in an electrolytic plating solution containing a cyanogen compound.

In this regard, if it is desired that only a predetermined part of the patterns formed on the surface of the circuit board is subjected to gold plating, the circuit board, the part which not to be plated with gold being covered with resist, is dipped into a gold-plating electrolytic solution.

However, when an electrolytic solution added with a cyanogen compound is used as a bath for gold plating, cyanogen ions corrode the resist to separate the latter from the surface of the circuit board. Thereby, the gold-plating electrolytic solution may enter a gap between the circuit board and the resist to form a gold film on a part of the circuit board which is not to be plated with gold.

Accordingly, when gold is plated to a predetermined portion of micro-patterns formed on the circuit board, gold is also plated to other portions not to be plated due to the entry of the gold-plating solution into the gap between the surface of the circuit board and the resist, which may cause a short-circuit between the micro-patterns.

To solve this problem, there has been proposed a non-cyanogen type electrolytic solution, containing a gold salt, as a supply source of gold, and a non-cyanogen type acetylcysteine as a complexing agent (see Japanese Unexamined Patent Publication No. 10-317183; pages 4 to 5).

According to the non-cyanogen type gold-plating electrolytic solution disclosed in the above-mentioned patent publication, it is possible to plate, with gold, only a predetermined portion of micro-patterns formed in a circuit board, the solution being less toxic and easily treatable as well as not being corrosive, due to cyanogen ions, to a resist coated on the circuit board because no cyanogen compound is added thereto. Thus, it is possible to plate gold on a predetermined portion of the micro-patterns formed on the circuit board.

However, it has been found that the gold-plating film obtained by using the non-cyanogen type gold-plating electrolytic solution disclosed in the above-mentioned patent publication is black in appearance and the gold-plating electrolytic solution bath lacks stability.

SUMMARY OF THE INVENTION

In view of the above-mentioned problems, an object of the present invention is to provide a non-cyanogen type gold-plating electrolytic solution capable of providing a gold-plating having golden luster and a good stability.

The present inventors has studied to solve the above-mentioned problems and found that when the electrolytic gold plating is carried by using a gold-plating electrolytic solution bath added with 2-aminoethanethiol as a compound for forming a complex compound with gold, the resultant gold-plating exhibits an appearance having golden luster and the stability of the gold-plating electrolytic solution bath is favorable. Thus, the present invention has been made.

That is, according to the present invention, there is provided a non-cyanogen type electrolytic solution for plating gold, containing gold salt, as a supply source of gold, and a non-cyanogen type compound, wherein the electrolytic plating solution is added with one selected from a group of thiouracil; 2-aminoethanethiol; N-methylthiourea; 3-amino-5-mercapto-1,2,4-triazole; 4,6-dihydroxy-2-mercaptopyrimidine; and mercapto-nicotinate; as a compound forming a complexing compound with gold.

In the present invention, chloroaurate or gold sulfite may be favorably used as a gold salt.

In the present invention, the non-cyanogen type compound preferably has a deposition potential in a range from −0.4 to −0.8 Vvs.SCE. The non-cyanogen type compound is preferably thiouracil or 2-aminoethane thiol. The hydrogen ion concentration pH of the non-cyanogen type compound is 12 to 5, and more preferably is 8 to 5.

According to another aspect of the present invention, there is provided a gold plating method using a non-cyanogen type electrolytic solution, containing gold salt as a supply source of gold and added with a non-cyanogen type compound, wherein the electrolytic plating solution is added with one selected from a group of thiouracil; 2-aminoethanethiol; N-methylthiourea, 3-amino-5-mercapto-1,2,4-triazole; 4,6-dihydroxy-2mercaptopyrimidine; and mercapto-nicotinate; as a compound forming a complexing compound with gold.

The gold plating is preferably carried out in a condition of a current density of 0.5 A/dm$^2$ or less.

DETAILED DESCRIPTION OF THIS INVENTION

The non-cyanogen type gold-plating electrolytic solution according to the present invention is one using a gold salt as a supply source of gold and added with a non-cyanogen type compound.

The gold salt is preferably chloroaurate or gold sulfite. In particularly, in view of cost and handling easiness, sodium chloroaurate is particularly favorable.

It is important that the non-cyanogen type compound is one capable of forming a complexing compound with gold, such as thiouracil, 2-aminoethanethiol, N-methylthiourea, 3-amino-5-mercapto-1,2,4-triazole, 4,6-dihydroxy-2-mercaptopyrimidine and mercapto-nicotinate Of these non-cyanogen type compounds, those having a deposition potential in a range from −0.4 to −0.8 Vvs.SCE are preferable. If the compound has a deposition potential closer to the positive side than −0.4 Vvs.SCE, the gold-plating electrolytic solution is liable to be unstable. On the other hand, if the compound has a deposition potential closer to a negative side than −0.8 Vvs.SCE, the deposition of gold is disturbed, whereby the quality of the plated gold film is liable to deteriorate.

Examples of the non-cyanogen type compound having the deposition potential in a range from −0.4 to −0.8 Vvs.SCE are thiouracil, 2-aminoethanethiol, N-methylthiourea, 3-amino-5-mercapto-1,2,4-triazole and mercapto-nicotinate. Particularly, thiouracil or 2-aminoethanethiol is preferably used.

The hydrogen ion concentration pH of the non-cyanogen type gold-plating electrolytic solution according to this invention is preferably in a range from 12 to 5. Particularly, to effectively prevent the resist coated on the circuit board from being corroded, the pH is preferably in a range between 8 (or lower) and 5.

For the purpose of the adjusting pH of the plating solution bath, known acids or alkalis may be used, as well as known pH buffers may be used, such as phosphoric acid, boric acid, acetic acid, citric acid and/or salts thereof.

Further, to improve the electric conductivity of the plating bath, known conduction agents may be used, such as alkaline metal salt or ammonium salt of sulfuric acid or hydrochloric acid.

Preferably, in view of the plating efficiency, the current density is adjusted to 0.5 A/dm$^2$ or less in the electrolytic plating using the non-cyanogen type gold-plating electrolytic solution according to this invention.

The present invention will be described in more detail below with reference to the preferred examples.

EXAMPLE 1

The plating was carried out by using a gold-plating electrolytic solution bath, of the following composition, in which a test piece of an iron-nickel alloy sheet was used as a cathode and a mesh-like platinum sheet was used as an anode.

The temperature of the gold-plating electrolytic solution bath was adjusted to a predetermined value while stirring the same by a stirrer, and then the electrolytic gold plating was carried out at a current density in a range from 0.1 to 0.5 A/dm$^2$. As a result, the test piece was favorably plated with gold.

Composition of Gold-Plating Electrolytic Solution

| | |
|---|---|
| sodium chloroaurate | 11.6 g/L |
| (Au component: 6 g/L) | |
| thiouracil | 23.1 g/L |
| (deposition potential: −0.65 Vvs.SCE) | |
| mono-potassium citrate | 45 g/L |
| tri-potassium citrate | 55 g/L |
| potassium hydroxide | 10 g/L |
| (pH) | 5.0 |
| (bath temperature) | 50° C. |

EXAMPLE 2

The electrolytic gold plating was carried out in the same manner as in Example 1 except that the composition of the gold-plating electrolytic solution, pH and the bath temperature were changed as follows. As a result, the test piece was favorably plated with gold.

Composition of Gold-Plating Electrolytic Solution

| | |
|---|---|
| sodium chloroaurate | 11.6 g/L |
| (Au component: 6 g/L) | |
| 2-aminoethanethiol | 14.0 g/L |
| (deposition potential: −0.45 Vvs.SCE) | |

-continued

| | |
|---|---|
| mono-potassium citrate | 45 g/L |
| tri-potassium citrate | 55 g/L |
| (pH) | 5.0 |
| (bath temperature) | 50° C. |

EXAMPLE 3

The electrolytic gold plating was carried out in the same manner as in Example 1 except that the composition of the gold-plating electrolytic solution, pH and the bath temperature were changed as follows. As a result, the test piece was favorably plated with gold.

Composition of Gold-Plating Electrolytic Solution

| | |
|---|---|
| sodium chloroaurate | 11.6 g/L |
| (Au component: 6 g/L) | |
| N-methyl-thiourea | 16.2 g/L |
| (deposition potential: −0.8 Vvs.SCE) | |
| mono-potassium citrate | 45 g/L |
| tri-potassium citrate | 55 g/L |
| (pH) | 5.0 |
| (bath temperature) | 50° C. |

EXAMPLE 4

The electrolytic gold plating was carried out in the same manner as in Example 1 except that the composition of the gold-plating electrolytic solution, pH and the bath temperature were changed as follows. As a result, the test piece was favorably plated with gold.

Composition of Gold-Plating Electrolytic Solution

| | |
|---|---|
| sodium chloroaurate | 11.6 g/L |
| (Au component: 6 g/L) | |
| 3-amino-5-mercapto-1,2,4-triazole | 16.2 g/L |
| (deposition potential: −0.85 Vvs.SCE) | |
| mono-potassium citrate | 45 g/L |
| tri-potassium citrate | 55 g/L |
| potassium hydroxide | 15 g/L |
| (pH) | 12.0 |
| (bath temperature) | 50° C. |

EXAMPLE 5

The electrolytic gold plating was carried out in the same manner as in Example 1 except that the composition of the gold-plating electrolytic solution, pH and the bath tempera ture were changed as follows. As a result, the test piece was favorably plated with gold.

Composition of Gold-Plating Electrolytic Solution

| | |
|---|---|
| sodium chloroaurate (Au component: 6 g/L) | 11.6 g/L |
| 4,6-dihydroxy-2-mercaptopyrimidine (deposition potential: −0.6 Vvs.SCE) | 25.9 g/L |
| mono-potassium citrate | 45 g/L |
| tri-potassium citrate | 55 g/L |
| potassium hydroxide | 20 g/L |
| (pH) | 12.5 |
| (bath temperature) | 50° C. |

EXAMPLE 6

The electrolytic gold plating was carried out in the same manner as in Example 1 except that the composition of the gold-plating electrolytic solution, pH and the bath temperature were changed as follows. As a result, the test piece was favorably plated with gold.

Composition of Gold-Plating Electrolytic Solution

| | |
|---|---|
| sodium chloroaurate (Au component: 6 g/L) | 11.6 g/L |
| 2-mercaptonicotinic acid (deposition potential: −0.6 Vvs.SCE) | 27.9 g/L |
| mono-potassium citrate | 45 g/L |
| tri-potassium citrate | 55 g/L |
| potassium hydroxide | 20 g/L |
| (pH) | 12.5 |
| (bath temperature) | 50° C. |

COMPARATIVE EXAMPLE 1

The electrolytic gold plating was carried out in the same manner as in Example 1 except that the composition of the gold-plating electrolytic solution, pH and the bath temperature were changed as follows. As a result, the test piece was favorably plated with gold.

Composition of Gold-Plating Electrolytic Solution

| | |
|---|---|
| sodium chloroaurate (Au component: 6 g/L) | 11.6 g/L |
| N-acetyl-L-cysteine (deposition potential: −0.8 Vvs.SCE) | 29.4 g/L |
| mono-potassium citrate | 45 g/L |
| tri-potassium citrate | 55 g/L |
| (pH) | 6.0 |
| (bath temperature) | 50° C. |

COMPARATIVE EXAMPLE 2

The electrolytic gold plating was carried out in the same manner as in Example 1 except that the composition of the gold-plating electrolytic solution, pH and the bath temperature were changed as follows.

However, as gold was deposited in the plating bath during the electrolytic gold plating, the electrolytic gold plating was stopped.

Composition of Gold-Plating Electrolytic Solution

| | |
|---|---|
| sodium chloroaurate | 30 g/L |
| N-acetyl-L-cysteine | 60 g/L |
| mercapto-citrate | 10 g/L |
| Potassium sulfate | 100 g/L |
| sodium acetate | 10 g/L |
| (pH) | 8.0 |
| (bath temperature) | 20° C. |

COMPARATIVE EXAMPLE 3

The electrolytic gold plating was carried out in the same manner as in Example 1 except that the composition of the gold-plating electrolytic solution, pH and the bath temperature were changed as follows. As a result, the test piece was favorably plated with gold.

Composition of Gold-Plating Electrolytic Solution

| | |
|---|---|
| sodium chloroaurate (Au component: 5 g/L) | 9.6 g/L |
| 2-mercaptoethanesulfonic acid, sodium salt (deposition potential: −0.85 Vvs.SCE) | 20 g/L |
| di-potassium hydrogenphosphate | 50 g/L |
| (pH) | 10.0 |
| (bath temperature) | 50° C. |

The stability in the room temperature of the gold-plating electrolytic solutions used in Examples 1 to 6 and Comparative examples 1 and 3 from which gold is favorably plated was tested, and the test pieces obtained therefrom were subjected to a visual test on the appearance of the gold films plated thereon results of which are shown in Table 1.

TABLE 1

| | Stability of gold-plating electrolytic bath | Appearance of plated gold film |
|---|---|---|
| Example 1 | ○-Δ | ○ |
| Example 2 | ○ | ○ |
| Example 3 | ○-Δ | ○-Δ |
| Example 4 | ○-Δ | ○-Δ |
| Example 5 | ○-Δ | ○-Δ |
| Example 6 | ○ | ○-Δ |
| Comparative example 1 | ○ | X |
| Comparative example 3 | ○ | X |

Note 1:
The stability of gold-plating electrolytic solution
○: The stability was maintained for one month after the preparation.
Δ: The stability was maintained for several days after the preparation (it is still possible to put into practice).
Note 2:
The appearance of the plated gold film
○: The appearance is rich in golden luster and uniform.
Δ: The appearance is rich in golden luster but not uniform (it is still possible to put into practice).
X: The appearance is black.

As apparent from Table 1, the gold-plating electrolytic solution in Examples 1 to 6 have a stability capable of being put into practice, and the gold films plated on the test pieces exhibit an appearance capable of being put into practice. Especially, Example 2 has a quality level capable of sufficiently being put into practice both in the stability of the gold-plating electrolytic solution and in the appearance of the gold film plated on the test piece.

On the other hand, while the gold-plating electrolytic solutions in Comparative examples 1 and 3 are capable of being put into practice, the appearance of the gold films plated on the test pieces is black and incapable of being put into practice.

EXAMPLE 7

After a photoresist was coated on one surface of a test piece, the photoresist was developed to create a circuit pattern of 30 μm wide.

Then, this test piece, one surface of which was coated with the patterned resist, was dipped into the gold-plating electrolytic solution used in Example 2 and subjected to the electrolytic gold plating carried out in the same way as in Example 2.

Thereafter, the test piece was taken out from the gold-plating electrolytic solution, and the resist was separated from the test piece. A shape of others of the circuit pattern thus formed was observed by a microscope.

As a result, it was found that the test piece has the circuit pattern of a sharp form free from the disturbance of the pattern due to the separation or corrosion of the resist.

EXAMPLE 8

The plating was carried out by using a gold-plating electrolytic solution bath of the following composition, in which a test piece of an iron-nickel alloy sheet was used as a cathode and a mesh-like platinum sheet was used as an anode.

The temperature of the gold-plating electrolytic solution bath was adjusted to a predetermined value while stirring the same by a stirrer, and then the electrolytic gold plating was carried out at a current density in a range from 0.1 to 0.5 A/dm$^2$. As a result, the test piece was favorably plated with gold.

Composition of Gold-Plating Electrolytic Solution

| | |
|---|---|
| sodium gold sulfite | 13.0 g/L |
| (Au component: 6 g/l) | |
| thiouracil | 23.1 g/L |
| (deposition potential: −0.65 Vvs.SCE) | |
| mono-potassium citrate | 45 g/L |
| tri-potassium citrate | 55 g/L |
| potassium hydroxide | 10 g/L |
| (pH) | 12.0 |
| (bath temperature) | 50° C. |

EXAMPLE 9

The electrolytic gold plating was carried out in the same manner as in Example 8 except that the composition of the gold-plating electrolytic solution, pH and the bath temperature were changed as follows. As a result, the test piece was favorably plated with gold.

Composition of Gold-Plating Electrolytic Solution

| | |
|---|---|
| sodium gold sulfite | 11.6 g/L |
| (Au component: 6 g/L) | |
| 2-aminoethanethiol | 14.0 g/L |
| (deposition potential: −0.45 Vvs.SCE) | |
| mono-potassium citrate | 45 g/L |
| tri-potassium citrate | 55 g/L |
| (pH) | 5.0 |
| (bath temperature) | 50° C. |

ADDITIONAL EXAMPLES

A plating efficiency was measured while changing the current density from 0.1 to 0.8 A/dm$^2$ in Examples 1 to 6, 8 and 9 and Comparative examples 1 and 3. The results are shown in Table 2.

In this regard, the plating efficiency was defined by the following equation based on a theoretical weight of deposited metal calculated from a current amount at the measured current density and plating time and an actual weight of deposited metal obtained by measuring the difference in sample weight between before and after the plating.

Plating efficiency (%)=(actual weight of deposited metal/theoretical weight of deposited metal)×100

TABLE 2

| | Plating efficiency (%) | | | |
|---|---|---|---|---|
| Current density (A/dm$^2$) | 0.1 | 0.3 | 0.5 | 0.8 |
| Example 1 | 94.6 | 98.1 | 98.4 | 43.5 |
| Example 2 | 97.7 | 95.2 | 95.8 | 70.4 |
| Example 3 | 94.7 | 96.1 | 94.3 | 91.0 |
| Example 4 | 95.6 | 97.1 | 93.8 | 78.6 |
| Example 5 | 99.5 | 98.5 | 95.0 | 79.1 |
| Example 6 | 98.1 | 96.7 | 94.6 | 88.3 |
| Example 8 | 98.9 | 98.4 | 98.8 | 96.1 |
| Example 9 | 98.8 | 96.3 | 94.8 | 73.1 |
| Comparative example 1 | 89.6 | 76.8 | 64.6 | 42.1 |
| Comparative example 3 | 52.1 | 30.5 | 12.2 | 11.2 |

As apparent from Table 2, the plating efficiency is higher in Examples 1 to 6, 8 and 9 than in Comparative examples 1 and 3. Especially, in Examples 1 to 6, 8 and 9, the plating efficiency exceeds 93% when the current density is 0.5 A/dm$^2$ or less.

According to the inventive non-cyanogen type gold-plating electrolytic solution, as no cyanogen-type compound is added, the gold-plating electrolytic solution is low in toxicity and excellent in handling ease, as well as being free from the corrosion of a resist, coated on the circuit board, by cyanogen ions. Thus, it is possible to form a gold film, by plating, at predetermined portions of micro-patterns formed on the circuit board.

In addition, the inventive non-cyanogen type gold-plating electrolytic solution is excellent in stability and is capable of providing a gold film exhibiting a golden luster.

Thus, the inventive non-cyanogen type gold-plating electrolytic solution is favorably used for forming a plated film of gold at predetermined portions of micro-patterns formed on a circuit board, in such a manner that, after a resist is coated at predetermined portions of the circuit board on which the micro-patterns are formed, the circuit board is dipped into a bath of the gold-plating electrolytic solution and subjected to the electrolytic plating of gold.

The invention claim is:

1. A non-cyanogen type electrolytic solution for plating gold, containing gold salt as a supply source of gold and added with a non-cyanogen type compound, wherein the electrolytic plating solution is added with one selected from a group of thiouracil; 3-amino-5-mercapto-1,2,4-triazole; and 4,6-dihydroxy-2-mercaptopyrimidine as a compound forming a complexing compound with gold; and wherein the electrolytic plating solution further contains mono-potassium citrate and tri-potassium citrate.

2. A non-cyanogen type electrolytic gold plating solution as set for claim 1, wherein chloroaurate or gold sulfite is used as gold salt.

3. A non-cyanogen type electrolytic gold plating solution as set for claim 2, wherein non-cyanogen type compound has a deposition potential in a range from −0.4 Vvs.SCE to −0.8 Vvs.SCE.

4. A non-cyanogen type electrolytic gold plating solution as set for claim 3, wherein non-cyanogen type compound is thiouracil.

5. A non-cyanogen type electrolytic gold plating solution as set for claim 3, wherein a hydrogen ion concentration pH of the non-cyanogen type compound is 12 to 5, and more preferably is 8 to 5.

* * * * *

UNITED STATES PATENT AND TRADEMARK OFFICE

CERTIFICATE OF CORRECTION

PATENT NO. : 7,261,803 B2
APPLICATION NO. : 10/661533
DATED : August 28, 2007
INVENTOR(S) : Miwa Abe et al.

It is certified that error appears in the above-identified patent and that said Letters Patent is hereby corrected as shown below:

Column 2, Line 31, change "2mercaptopyrimidine;" to --2-mercaptopyrimidine;--.

Column 2, Line 52, after "nicotinate" insert --.--.

Column 6, Line 42, change "thereon. results" to --thereon, results--.

Signed and Sealed this

Eleventh Day of March, 2008

JON W. DUDAS
*Director of the United States Patent and Trademark Office*